US008875799B2

(12) United States Patent
Smith et al.

(10) Patent No.: US 8,875,799 B2
(45) Date of Patent: Nov. 4, 2014

(54) COVERED RETAINING SHOE CONFIGURATIONS FOR USE IN A DOWNHOLE TOOL

(75) Inventors: Donald Ray Smith, Wilson, OK (US); Anthony Valencia, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 634 days.

(21) Appl. No.: 13/178,951

(22) Filed: Jul. 8, 2011

(65) Prior Publication Data

US 2013/0008673 A1 Jan. 10, 2013

(51) Int. Cl.

| | |
|---|---|
| ***E21B 23/06*** | (2006.01) |
| ***E21B 33/12*** | (2006.01) |
| ***E21B 33/129*** | (2006.01) |
| ***E21B 33/128*** | (2006.01) |

(52) U.S. Cl.

CPC ..... *E21B 33/1216* (2013.01); *E21B 33/1292* (2013.01); *E21B 33/128* (2013.01)

USPC ..... 166/387; 166/118

(58) Field of Classification Search

USPC ..... 166/207, 387, 381, 118

See application file for complete search history.

(56) References Cited

U.S. PATENT DOCUMENTS

| | | | | |
|---|---|---|---|---|
| 3,799,260 | A | 3/1974 | Barrington | |
| 4,337,010 | A | 6/1982 | Sullaway et al. | |
| 4,438,933 | A | 3/1984 | Zimmerman | |
| 4,664,188 | A | 5/1987 | Zunkel et al. | |
| 4,730,835 | A * | 3/1988 | Wilcox et al. | 277/342 |
| 5,044,434 | A | 9/1991 | Burns, Sr. et al. | |
| 5,117,910 | A | 6/1992 | Brandell et al. | |
| 5,152,340 | A | 10/1992 | Clark et al. | |
| 5,224,540 | A | 7/1993 | Streich et al. | |
| 5,311,938 | A | 5/1994 | Hendrickson et al. | |
| 5,433,269 | A | 7/1995 | Hendrickson | |
| 5,540,279 | A | 7/1996 | Branch et al. | |
| 5,701,959 | A | 12/1997 | Hushbeck et al. | |
| 5,857,520 | A | 1/1999 | Mullen et al. | |
| 6,167,963 | B1 * | 1/2001 | McMahan et al. | 166/179 |
| 6,343,791 | B1 * | 2/2002 | Anyan et al. | 277/337 |
| 6,394,180 | B1 | 5/2002 | Berscheidt et al. | |
| 6,491,116 | B2 | 12/2002 | Berscheidt et al. | |
| 6,695,050 | B2 | 2/2004 | Winslow et al. | |
| 6,695,051 | B2 | 2/2004 | Smith et al. | |
| 6,966,386 | B2 | 11/2005 | Ringgenberg et al. | |
| 7,234,522 | B2 | 6/2007 | Johnson et al. | |
| 7,328,750 | B2 | 2/2008 | Swor et al. | |
| 7,373,973 | B2 | 5/2008 | Smith et al. | |
| 8,157,019 | B2 * | 4/2012 | King et al. | 166/387 |
| 2003/0226659 | A1 | 12/2003 | Smith et al. | |
| 2003/0226660 | A1 | 12/2003 | Winslow et al. | |
| 2008/0060821 | A1 | 3/2008 | Smith et al. | |
| 2010/0243254 | A1 * | 9/2010 | Murphy et al. | 166/305.1 |

* cited by examiner

*Primary Examiner* — Catherine Loikith

(74) *Attorney, Agent, or Firm* — McDermott Will & Emery LLP; John W. Wustenberg

(57) ABSTRACT

A downhole apparatus suitable for downhole application may include a mandrel; a packer element assembly disposed about the mandrel that comprises at least one packer element disposed about the mandrel; and a retaining shoe disposed about the mandrel and adjacent to a first packer element of the packer element assembly. The retaining shoe may be configured such that in an unset position at least a portion of the first packer element covers at least a portion of a retaining shoe distal surface.

19 Claims, 4 Drawing Sheets

COVERED RETAINING SHOE CONFIGURATIONS FOR USE IN A DOWNHOLE TOOL

BACKGROUND

The present invention relates to a retaining shoe configuration and its use in a packer, frac plug, or bridge plug in downhole applications.

In the drilling or reworking of oil wells, a great variety of downhole tools are used. For example, a packer may be used to support production tubing and other completion equipment, such as sand control assemblies adjacent to a producing formation, and to seal the annulus between the outside of the production tubing and the inside of the well casing to block movement of fluids through the annulus past the packer location. Packers are commonly run into the wellbore on a conveyance such as a wireline, work string, or production tubing.

Typically, packers may have an upper and a lower set of anchor slips with opposed camming surfaces, which cooperate with complementary opposed wedging surfaces, whereby the anchor slips are outwardly radially extendable into gripping engagement against the well casing bore in response to relative axial movement of the wedging surfaces. Packers may also carry annular seal assembly including one or more seal elements, which are radially expandable into sealing engagement against the bore of the well casing in response to axial compression forces.

Prior to actuation and the subsequent radial expansion of the seal elements, many adverse environmental conditions may exist around the outer diameter of the seal elements. For example, certain completion operations, especially those in a horizontal wellbore, require fluids to be circulated in the annulus between the well casing and the packer at high rates. It has been found that such high flow rates of wellbore fluids may create a low pressure region around and adjacent to the outer diameter of the packers and the seal elements. It has also been found that this low pressure region may cause the seal elements to prematurely expand, thus causing the packer to set.

Therefore, a need has arisen for a packer that is capable of being deployed in adverse environments such that its seal elements are not affected by the adverse environments, such as high circulation rate fluids, prior to setting the packer.

SUMMARY OF THE INVENTION

The present invention relates to a retaining shoe configuration and its use in a packer, frac plug, or bridge plug in downhole applications.

In one embodiment, a downhole apparatus comprises: a mandrel; a packer element assembly disposed about the mandrel that comprises at least one packer element disposed about the mandrel; and a retaining shoe disposed about the mandrel and adjacent to a first packer element of the packer element assembly, wherein in an unset position at least a portion of the first packer element covers at least a portion of a retaining shoe distal surface.

In one embodiment, a downhole apparatus comprises: a mandrel; a packer element assembly disposed about the mandrel that comprises at least one packer element disposed about the mandrel; and a retaining shoe disposed about the mandrel and adjacent to a first packer element of the packer element assembly, wherein in an unset position within a wellbore at least a portion of the first packer element is disposed between at least a portion of a retaining shoe distal surface and the wellbore.

In one embodiment, a downhole apparatus comprises: a mandrel; a packer element assembly disposed about the mandrel that comprises at least one packer element disposed about the mandrel; and a retaining shoe disposed about the mandrel and adjacent to a first packer element of the packer element assembly, wherein the retaining shoe comprises an inner shoe and an outer shoe such that the inner shoe is proximal to the mandrel and proximal to the first packer element relative to the outer shoe, and wherein a inner shoe distal surface is proximal to the mandrel relative to an outer shoe distal surface.

In one embodiment, a method of sealing a wellbore comprises: providing a downhole apparatus comprising: a mandrel; a packer element assembly disposed about the mandrel with an upper end and a lower end, wherein the packer element assembly comprises a first packer element at the upper end and a second packer element at the lower end; and an upper retaining shoe and a lower retaining shoe disposed about the mandrel and adjacent to the packer element assembly such that the upper retaining shoe is adjacent to the first packer element and the lower retaining shoe is adjacent to the second packer element, wherein in an unset position at least one of the first packer element covers at least a portion of an upper retaining shoe distal surface or the second packer element covers at least a portion of a lower retaining shoe distal surface; placing the downhole apparatus in a wellbore; and setting the downhole apparatus such that the first packer element and the second packer element expand radially and engage the wellbore when compressed by opposing retaining shoes.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present invention relates to a retaining shoe configuration and its use in a packer, frac plug, or bridge plug in downhole applications.

Packers typically have at least one means for allowing fluid communication through the tool. Packers may therefore allow for the controlling of fluid passage through the tool by way of one or more valve mechanisms which may be integral to the packer body or which may be externally attached to the packer body. Packer tools may be deployed in wellbores having casings or other such annular structure or geometry in which the tool may be set.

Frac plugs typically set in a wellbore to isolate the portion thereabove from the portion therebelow so that fluid can be forced into a formation above the frac plug. When frac plugs are set in the well, however, they will allow flow in one direction. Frac plugs therefore may generally be used when it is desired to produce fluid from zones above and below the frac plug. When fluid is pumped into a well above a frac plug such that pressure above the frac plug is greater than the pressure therebelow, the frac plug will prevent flow downwardly therethrough so that the fluid may be forced into a formation thereabove. Once such treatment is completed and pressure below the frac plug is greater than the pressure thereabove, fluid from below the frac plug may flow upwardly through the frac plug and along with fluid from any formations above the frac plug can be flowed to the surface.

Bridge plugs generally completely isolate the portion of the wellbore below the bridge plug from the portion thereabove. Such bridge plugs may often be made of drillable components so that they can be drilled from the well after use.

In descriptions of embodiments of the invention, directional terms, such as "above," "below," "upper," "lower," etc., are used for convenience in referring to the accompanying drawings. Directional terms should be taken for reference to the drawings only and not relative to the earth's surface during implementation of downhole apparatus 10 unless otherwise stated.

Figure 1A:
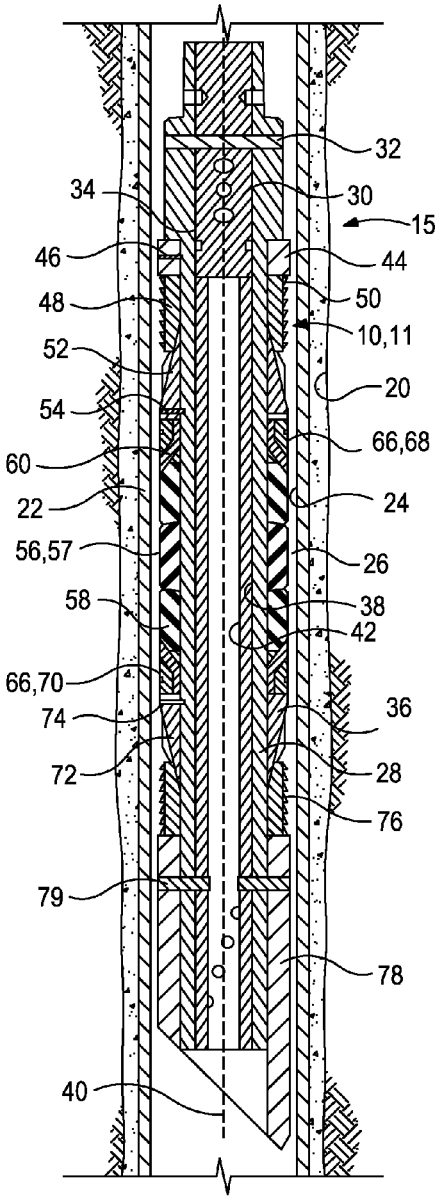
FIG. 1a (Prior Art)
FIGS. 1A-1B are prior art cross-sectional side views of a packer apparatus within a wellbore in the unset position and the set position.
Figure 1B:
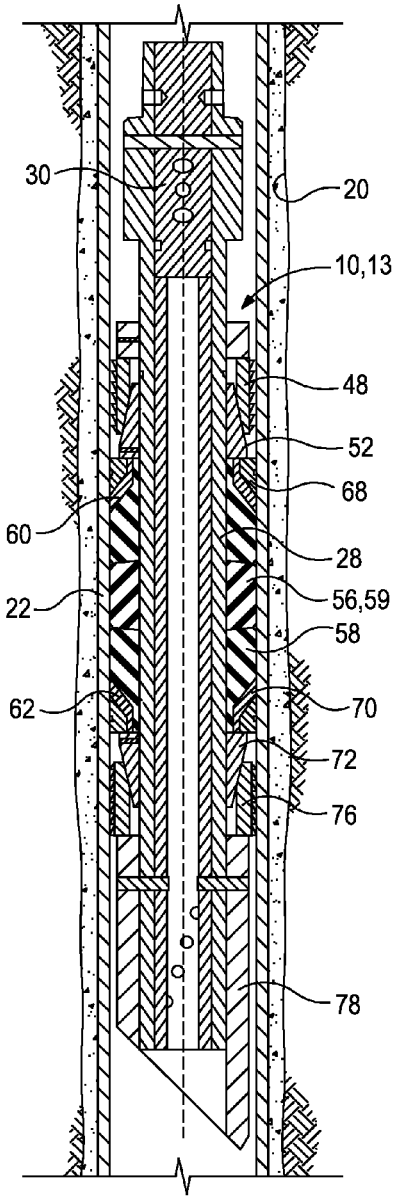
FIG. 1b (Prior Art)
Figure 2A:
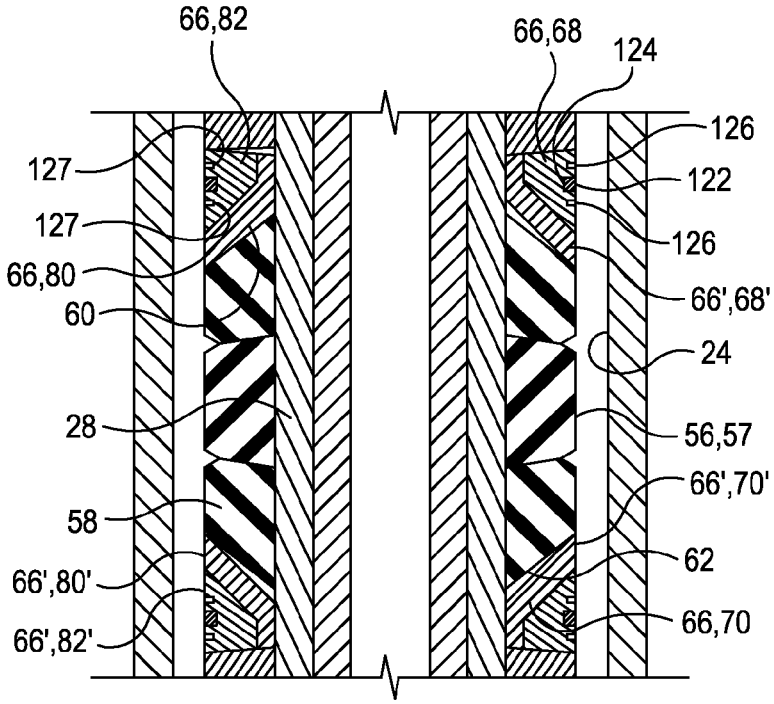
FIG. 2a (Prior Art)
FIGS. 2A-2B are prior art cross-sectional side views of a packer element and upper and lower retaining shoes in the unset position.

Referring to FIGS. 1A and 2A, a non-limiting general example of a downhole tool, downhole apparatus 10 is shown in an unset position 11 in a well 15 having a wellbore 20. The wellbore 20 can be either a cased completion with a casing 22 cemented therein, as shown in FIGS. 1A-B, or an openhole completion. Downhole apparatus 10 is shown in set position 13 in FIG. 1B. Casing 22 has an inner surface 24 and annulus 26 is defined by casing 22 and downhole apparatus 10. Downhole apparatus 10 has a mandrel 28, and may be referred to as a bridge plug due to the downhole apparatus 10 having a plug 30 being pinned within mandrel 28 by radially oriented pins 32. Plug 30 has a seal means 34 located between plug 30 and the internal diameter of mandrel 28 to prevent fluid flow therebetween. The overall downhole apparatus 10 structure, however, is adaptable to tools referred to as packers, frac plugs, and bridge plugs.

Mandrel 28 has an outer surface 36, an inner surface 38, and a longitudinal central axis, or axial centerline 40. An inner tube 42 is disposed in, and is pinned to, mandrel 28 to help support plug 30. Downhole apparatus 10, which may also be referred to as bridge plug 10, includes the usage of a spacer ring 44 that is preferably secured to mandrel 28 by pins 46. Spacer ring 44 provides an abutment that serves to axially retain slip segments 48 that are positioned circumferentially about mandrel 28. Slip retaining bands 50 serve to radially retain slip segments 48 in an initial circumferential position about mandrel 28 as well as slip wedge 52. Bands 50 are made of a steel wire, a plastic material, or a composite material having the requisite characteristics of having sufficient strength to hold the slip segments 48 in place prior to actually setting the downhole apparatus 10 and to be easily drillable when the downhole apparatus 10 is to be removed from the wellbore 20. Preferably, bands 50 are inexpensive and easily installed about slip segments 48. Slip wedge 52 is initially positioned in a slideable relationship to, and partially underneath, slip segments 48 as shown in FIG. 1. Slip wedge 52 is shown pinned into place by pins 54. In some embodiments, the preferred designs of slip segments 48 and co-acting slip wedges 52 are described in U.S. Pat. No. 5,540,279, which is incorporated herein by reference.

Located below slip wedge 52 is a packer element assembly 56, which includes at least one packer element. FIG. 1 shows an embodiment having three expandable packer elements 58 positioned about mandrel 28. Packer element assembly 56 has unset and set positions 57 and 59, respectively, corresponding to the unset and set positions 11 and 13, respectively, of downhole apparatus 10, as depicted in FIGS. 1 and 2A. Packer element assembly 56 has upper end 60 and lower end 62.

Figure 2B:
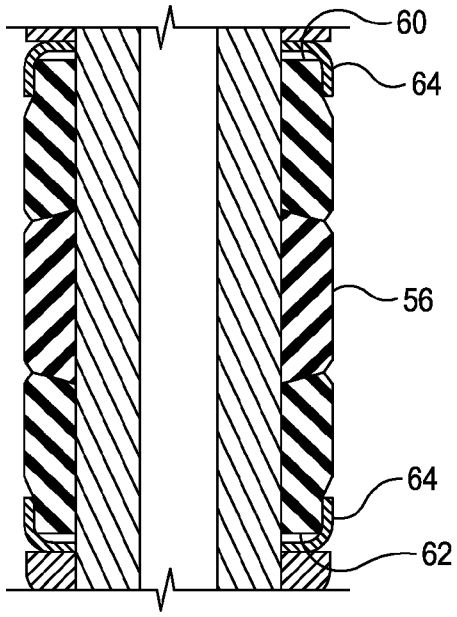
FIG. 2b (Prior Art)

FIG. 2B shows a prior art arrangement wherein a single metallic shoe, such as shoe 64, is disposed about the upper and lower ends 60 and 62 of the packer element assembly 56. Referring to FIGS. 1A-B, a suitable downhole apparatus 10 for use with the present invention has retaining rings 66 disposed at the upper and lower ends 60 and 62 of packer element assembly 56 to axially retain the packer element assembly 56. Retaining rings, or retaining shoes 66 may be referred to as an upper retaining shoe, or upper retainer 68 and a lower retaining shoe, or lower retainer 70. A slip wedge 72 is disposed on mandrel 28 below lower retaining shoe 70 and is pinned with a pin 74. Located below slip wedge 72 are slip segments 76. Slip wedge 72 and slip segments 76 are like slip wedge 52 and slip segments 48. At the lowermost portion of downhole apparatus 10 is an angled portion, referred to as mule shoe 78, secured to mandrel 28 by pin 79. The lowermost portion of downhole apparatus 10 need not be mule shoe 78 but can be any type of section that will serve to terminate the structure of the downhole apparatus 10 or serve to connect the downhole apparatus 10 with other tools, a valve or tubing, etc. It will be appreciated by those in the art that pins 32, 46, 54, 74, and 79, if used at all, are preselected to have shear strengths that allow for the downhole apparatus 10 to be set and deployed and to withstand the forces expected to be encountered in the wellbore 20 during the operation of the downhole apparatus 10.

Referring now to FIG. 2A, in some embodiments, upper and lower retaining shoes 68 and 70 are essentially identical. Therefore, the same designating numerals will be used to further identify features common to all figures. Retaining shoes 66 comprise an inner shoe, or inner retainer 80 and an outer shoe, or outer retainer 82. Inner and outer shoes 80 and 82 may also be referred to as first and second shoes or retainers 80 and 82. Inner and outer shoes 80 and 82 have distal surfaces 80' and 82'. Further, inner shoe distal surface 80' and outer shoe distal surface 82' together form retaining shoe distal surface 66'.

In some embodiments, as generally depicted in FIG. 2A, an O-ring 122 is received in a groove 124 in outer shoe 82. Retaining bands 126 are received in grooves 127. Retaining bands 126 are preferably made of a non-metallic material, such as composite materials available from General Plastics & Rubber Company, Inc., Houston, Tex. However, retaining bands 126 may be alternatively made of a metallic material such as ANSI 1018 (steel) or any other material having sufficient strength to support and retain the retaining shoes 66 in position prior to actually setting the downhole apparatus 10. Furthermore, retaining bands 126 may have either elastic or non-elastic qualities depending on how much radial, and to some extent axial, movement of the outer shoe 82 can be tolerated prior to enduring the deployment of the associated downhole apparatus 10 into the wellbore 20.

When the downhole apparatus 10 is converted to its set position 13, outer distal surface 82' of outer shoe 82 will engage inner surface 24 of casing 22 as will inner shoe distal surface 80' of inner shoe 80.

Importantly, even though FIGS. 1A-B and 2A-B depict prior art downhole apparatus 10 in a vertical well, it should be understood by one skilled in the art that downhole apparatus 10 using a retaining shoe configuration of the present invention is equally well-suited for use in deviated wells, inclined wells or horizontal wells. Also, it should be understood by one skilled in the art that downhole apparatus 10 is equally well-suited for use in onshore and offshore operations.

Figure 3:
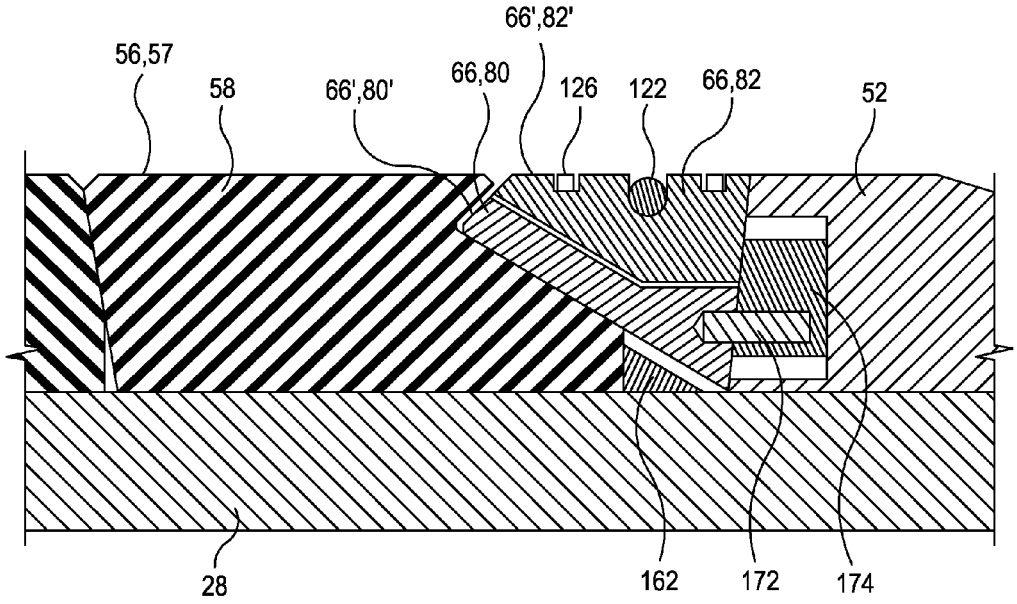
FIG. 3 is a partial cross-sectional side view of a packer element and one embodiment of a retaining shoe configuration of the present invention.

Now referring to the retaining shoe configurations of the present invention, a non-limiting example of which is depicted in FIG. 3. One skilled in the art, with the benefit of this disclosure, should understand that the retaining shoe configuration of the present invention may be used in any known downhole apparatus configurations having a retaining shoe, such as retaining shoe 66 configurations in FIGS. 1A-B and 2A. One skilled in the art would understand that FIGS. 1A-B and 2A-B have been included herein to provide non-limiting examples and context for, inter alia, downhole apparatus 10, unset position 11, and set position 13 where the retaining shoe configuration of the present invention may be used in place of the prior art retaining shoe configuration. When referring to FIG. 3, elements from FIGS. 1A-B and 2A-B may be referred to in order to provide spatial relationships as if FIG. 3 where employed in downhole apparatus 10, or the like.

It should be noted that when "about" is provided at the beginning of a numerical list, "about" modifies each number of the numerical list. It should be noted that in some numerical listings of ranges, some lower limits listed may be greater than some upper limits listed. One skilled in the art will recognize that the selected subset will require the selection of an upper limit in excess of the selected lower limit.

Of the many advantages, the present invention provides for a retaining shoe configuration that is less susceptible to prematurely extruding packer elements 58 of packer element assembly 56 while placing downhole apparatus 10 in wellbore 20. The present retaining shoe configurations allow for higher flow rates of the fluid while downhole apparatus 10 is being placed in a wellbore 20. This may be especially advantageous when placing downhole apparatus 10 in wellbore 20 of a horizontal well. Suitable flow rates of the fluid may range from a lower limit of greater than about 0 barrels per minute ("BPM") or about 1 BPM, 2 BPM, 3 BPM, or 5 BPM with an upper limit of about 20 BPM, 17 BPM, 15 BPM, 12 BPM, or 10 BPM, wherein the fluid flow rate may range from any lower limit to any upper limit and encompass any subset between the upper and lower limits. It should be noted that downhole apparatus 10 may be placed into wellbore 20 by any means known to one skilled in the art including, but not limited to, by wireline, work string, or production tubing.

Referring to FIG. 3, in some embodiments, the retaining shoe configuration of the present invention may be such that when retaining shoe 66 is installed in unset position 11 about mandrel 28 of downhole apparatus 10 adjacent to packer element assembly 56, retaining shoe distal surface 66' is at least partially covered by adjacent packer element 58. In some embodiments, retaining shoe distal surface 66' in unset position 11 may be covered by adjacent packer element 58 in an amount ranging from a lower limit of about 5%, 10%, 20%, 30%, 40%, or 50% to an upper limit of about 100%, 99%, 90%, 80%, 70%, 60%, or 50%, and wherein the coverage may range from any lower limit to any upper limit and encompass any subset between the upper and lower limits.

By way of nonlimiting example, retaining shoe 66 may comprise an inner shoe 80 and an outer shoe 82 such that when disposed about the mandrel 28 in unset position 11, inner shoe 80 is proximal to mandrel 28 and proximal to packer element assembly 56 relative to outer shoe 82, as described in U.S. Pat. No. 6,695,050, which is incorporated herein by reference. As such, retaining shoe 66 configuration of the present invention allows for inner shoe distal surface 80' to be at least partially covered by adjacent packer element 58. A nonlimiting example of such a configuration is shown in FIG. 3. In embodiments with inner shoe 80, inner shoe distal surface 80' in unset position 11 may be covered by adjacent packer element 58 in an amount of about 90% to about 100%. In some embodiments with outer shoe 82, outer shoe distal surface 82' in unset position 11 may be covered by adjacent packer element 58 in an amount ranging from an upper limit of about 0%, 1%, 5%, 10%, 20%, 30%, 40%, or 50% to an upper limit of about 100%, 99%, 90%, 80%, 70%, 60%, or 50%, and wherein the coverage may range from any lower limit to any upper limit and encompass any subset between the upper and lower limits.

In some embodiments, a retaining shoe configuration of the present invention may be such that retaining shoe 66 once installed about mandrel 28 in unset position 11 allows for inner shoe distal surface 80' to be proximate to mandrel 28 relative to outer shoe distal surface 82'. In some embodiments, packer element 58 adjacent to retaining shoe 66 may contact at least a portion of inner shoe distal surface 80' and/or at least a portion of outer shoe distal surface 82'.

In some embodiments, a retaining shoe configuration of the present invention may be such that when retaining shoe 66 is in unset position 11 installed about mandrel 28 of downhole apparatus 10 adjacent to packer element assembly 56 and used in a wellbore 20, at least a portion of adjacent packer element 58 is disposed between retaining shoe distal surface 66' and wellbore 20. In some embodiments, the amount of retaining shoe distal surface 66' in unset position 11 with adjacent packer element 58 disposed between retaining shoe distal surface 66' and wellbore 20 may range from a lower limit of about 5%, 10%, 20%, 30%, 40%, or 50% to an upper limit of about 100%, 99%, 90%, 80%, 70%, 60%, or 50%, and wherein the amount may range from any lower limit to any upper limit and encompass any subset between the upper and lower limits. One skilled in the art would understand that wellbore 20 may have casing 22 and at least a portion of adjacent packer element 58 would be disposed between at least a portion of retaining shoe distal surface 66' and casing 22.

It should be noted that, the term "casing" as used herein refers to tubular materials, which are used to form protective linings in wellbores. One skilled in the art will understand that a liner is included in the term casing. Casing 22 may be made from any material such as metals, plastics, composites, and the like; may be expanded or unexpanded as part of an installation procedure; and may be segmented or continuous. Additionally, it is not necessary for casing 22 to be cemented in wellbore 20. Any type of casing 22 may be used in keeping with the principles of the present invention.

In some embodiments where retaining shoe 66 comprises inner shoe 80 and outer shoe 82, inner shoe distal surface 80' in unset position 11 may have 90% to 100% of inner shoe distal surface 80' with at least a portion of adjacent packer element 58 disposed between it and wellbore 20. In some embodiments where retaining shoe 66 comprises inner shoe 80 and outer shoe 82, outer shoe distal surface 82' in unset position 11 may have at least a portion of adjacent packer element 58 disposed between it and wellbore 20. In such embodiments, the amount of outer shoe distal surface 82' in unset position 11 with at least a portion of adjacent packer element 58 disposed between it and wellbore 20 may range from an upper limit of about 0%, 1%, 5%, 10%, 20%, 30%, 40%, or 50% to an upper limit of about 100%, 99%, 90%, 80%, 70%, 60%, or 50%, and wherein the amount may range from any lower limit to any upper limit and encompass any subset between the upper and lower limits.

In some embodiments, downhole apparatus 10 may be characterized by having an upper end and a lower end at opposing ends of a longitudinal central axis. As such, downhole apparatus 10 may have upper retaining shoe 68 and lower retaining shoe 70 disposed about mandrel 28 such that upper retaining shoe 68 is proximal to upper end of packer element assembly 56 and lower retaining shoe 70 is proximal to the lower end of packer element assembly 56. In such embodiments where upper retaining shoe 68 or lower retaining shoe 70 comprise an inner shoe 80 and an outer shoe 82, the respective upper or lower inner shoe 80 will be proximal to its respective upper or lower end of packer element assembly 56 relative to its respective upper or lower outer shoe 82. This relative configuration can be seen in FIGS. 1 and 2A.

In some embodiments, downhole apparatus 10 may be configured such that packer element assembly 56 can radially expand and packer elements 58 engage wellbore 20, or casing 22, when compressed by opposing retaining shoes, i.e., upper retaining shoe 68 and lower retaining shoe 70. In some embodiments, retaining shoe 66, upper retaining shoe 68 and lower retaining shoe 70, outer shoe or shoe segment pairs may move radially outward from unset position 11 to set position 13 such that retaining shoe 66 or outer shoe 82 engages the wellbore 20, or casing 22.

In some embodiments, retaining shoe 66 may comprise inner shoe 80 with segments and outer shoe 82 with segments. As such, an inner shoe segment may be affixed to a corresponding outer shoe segment forming a shoe segment pair. Suitable forms of affixing may be any suitable form of affixing including, but not limited to, with tape, glue, epoxy, or the like. One skilled in the art should understand that inner shoe 80 and outer shoe 82 may comprise any number of segments including, but not limited to, one, two, three, four, five, six, seven, eight, nine, ten, and so on. Further, one skilled in the art would understand that upper inner shoe 80 and outer shoe 82 and lower inner shoe 80 and outer shoe 82 may have a different number of segments, so long as each inner shoe segment has a corresponding outer shoe segment.

The retaining shoe configuration of the present invention may be used in any known downhole apparatus 10 configuration. Generally downhole apparatus 10 comprises packer element assembly 56 and retaining shoe 66 disposed about mandrel 28 such that packer element assembly 56 is adjacent to retaining shoe 66. One skilled in the art should understand that packer element assembly 56 may be a collection of packer elements 58. Suitable downhole apparatus 10 in which retaining shoe 66 with a configuration of the present invention may be used includes, but is not limited to, those downhole apparatus 10 disclosed in U.S. Pat. Nos. 7,373,973; 6,695,051; 6,695,050; 6,491,116; 6,394,180; 5,701,959; 5,224,540, the relevant portions of which are included herein by reference. One skilled in the art with the benefit of this disclosure will understand that "retaining shoe" may be referred to by other names in other disclosures including, but not limited to, "packer shoe" and "extrusion limiter." Additionally, one skilled in the art with the benefit of this disclosure will understand any known retaining shoe 66 configuration may be adapted as described herein to achieve a retaining shoe configuration of the present invention.

Further, one skilled in the art, with the benefit of this disclosure, would understand that the retaining shoe configuration of the present invention may be used in all or some of retaining shoes 66 in known downhole apparatus 10 configurations. By way of nonlimiting example, referring to FIG. 3, retaining shoe 66 with a configuration of the present invention may be used in downhole apparatus 10 that comprises guide pin 172 connected to, and extending from, inner shoe 80. Slip wedge 52 has guide slot 174 defined therein. Inner wedge 162 is slideable relative to inner shoe 80 when the downhole apparatus 10 is moved from its unset position 11 to its set position 13. Inner wedge 162 may be disposed about mandrel 28, between at least a portion of inner shoe 80 and mandrel 28, and adjacent to adjacent packer element 58. Slip wedge 52 may be disposed about mandrel 28 such that retaining shoe 66 is disposed between adjacent packer element 58 and slip wedge 52. Additional details of the mechanism of the general retaining shoe configuration of this nonlimiting example that comprises guide slot 174, guide pin 172, slip wedge 52, and inner wedge 162 can be found in U.S. Pat. No. 6,695,050, which is incorporated herein by reference.

Additionally, one skilled in the art would understand that the retaining shoe configuration of the present invention may be used in upper retaining shoe 68 and/or lower retaining shoe 70. By way of nonlimiting example, downhole apparatus 10 may be configured such that the upper and lower portions of downhole apparatus 10 each comprise six retaining shoes 66 with only three from the upper portion and three from the lower portion being retaining shoe 66 with a configuration of the present invention. Additionally, multiple retaining shoe configurations of the present invention may be used in a single downhole apparatus 10.

Given the variety of retaining shoe configurations of the present invention, one skilled in the art would understand that packer element 58 adjacent to retaining shoe 66 should be appropriately designed to achieve the relative configurations of packer element 58 adjacent to retaining shoe 66 described herein. By way of nonlimiting example, packer element 58 may be designed with a lip, as shown in FIG. 3, that extents over retaining shoe distal surface 66' when installed adjacent to retaining shoe 66 with a configuration of the present invention in unset position 11 about mandrel 28 of downhole apparatus 10. One skilled in the art with the benefit of this disclosure should understand the plurality of configurations for packer element 58 adjacent to a retaining shoe configuration of the present invention.

Retaining shoe 66 may be made of any material suitable for use in a subterranean formation. Examples of suitable materials include, but are not limited to, metallic materials; nonmetallic materials like polymers, rubbers, elastomers, composites, and ceramics; and any combination thereof. In some embodiments, outer shoe 82 is preferably made of a phenolic material available from General Plastics & Rubber Company, Inc., 5727 Ledbetter, Houston, Tex. 77087-4095, which includes a direction-specific laminate material referred to as GP-B35F6E21K. Alternatively, structural phenolics available from commercial suppliers may be used. In some embodiments, inner shoes 80 are preferably made of a composite material available from General Plastics & Rubber Company, Inc., Houston, Tex. A particularly suitable material for at least a portion of the inner shoe 80 includes a direction specific composite material referred to as GP-L45425E7K (composite material, available from General Plastics & Rubber Company, Inc.). Alternatively, structural phenolics available from commercial suppliers may be used.

A setting tool may move downhole apparatus 10 into set position 13 from unset position 11. Suitable setting tools may be characterized by the setting mechanism, which may include, but not be limited to, powder charge, electric line, hydraulic, mechanical, and any combination thereof.

In some embodiments, downhole apparatus 10 may include mandrel 28; packer element assembly 56 disposed about mandrel 28 with at least one packer element 58 disposed about mandrel 28; and retaining shoe 66 disposed about mandrel 28 and adjacent to a first packer element 58 of packer element assembly 56. In said downhole apparatus 10 in unset position 11, at least a portion of the first packer element 58 may cover at least a portion of a retaining shoe distal surface 66'.

In some embodiments, downhole apparatus 10 may include mandrel 28; packer element assembly 56 disposed about mandrel 28 with at least one packer element 58 disposed about mandrel 28; and retaining shoe 66 disposed about mandrel 28 and adjacent to a first packer element 58 of packer element assembly 56. In said downhole apparatus 10 in unset position 11 within wellbore 20, at least a portion of the first packer element 58 may be disposed between at least a portion of retaining shoe distal surface 66' and wellbore 20.

In some embodiments, downhole apparatus 10 may include mandrel 28; packer element assembly 56 disposed about mandrel 28 with at least one packer element 58 disposed about mandrel 28; and retaining shoe 66 disposed about mandrel 28 and adjacent to a first packer element 58 of packer element assembly 56. In said downhole apparatus 10, retaining shoe 66 may include inner shoe 80 and outer shoe 82 such that inner shoe 80 is proximal to mandrel 28 and proximal to the first packer element 58 relative to outer shoe 82. Further, inner shoe distal surface 80' may be proximal to mandrel 28 relative to outer shoe distal surface 82'.

In some embodiments, sealing wellbore 20 may be done with downhole apparatus 10, which includes mandrel 28; packer element assembly 56 disposed about the mandrel 28 with an upper end and a lower end, wherein packer element assembly 56 comprises a first packer element 58 at the upper end and a second packer element 58 at the lower end; and upper retaining shoe 68 and lower retaining shoe 70 with each disposed about mandrel 28 and adjacent to packer element assembly 56 such that upper retaining shoe 68 is adjacent to the first packer element 58 and lower retaining shoe 70 is adjacent to the second packer element 58. In said downhole apparatus 10 in unset position 11, at least one of the first packer element 58 covers at least a portion of upper retaining shoe distal surface 68' or the second packer element 58 covers at least a portion of lower retaining shoe distal surface 70'. The process of sealing may include placing downhole apparatus 10 in wellbore 20 and setting downhole apparatus 10 such that the first packer element 58 and the second packer element 58 expand radially and engage wellbore 20 when compressed by opposing retaining shoes 68 and 70.

To facilitate a better understanding of the present invention, the following examples of preferred embodiments are given. In no way should the following examples be read to limit, or to define, the scope of the invention.

EXAMPLES

A retaining shoe configuration was tested for flow qualifications. The retaining shoes were installed on a 4½ inch heavy weight (3.44 OD) Fas drill plug assembly (101924679 variants) with composite/ceramic upper slips and cast iron lower slips. The frac plugs were tested in P-110 grade 15.10 PPF (3.826 ID) casing.

The retaining shoe designed according to the present invention was a 3-piece element with about 10% of retainer shoe distal surface 66' covered by adjacent packer element 58 in a 3-piece element adhered together with epoxy.

After a safety meeting, the flow test was performed with a flow rate profile of 3 BPM for 15 minutes, increased to 5 BPM for 15 minutes, increased to 6 BPM for 15 minutes, and increased by 1 BPM every 15 minutes until a pressure spike occurred on the top pressure reading. The pressure spike indicates that a component of the tool has flared out. If no pressure spike occurred, the flow test was concluded after 15 minutes at 14 BPM. It should be noted that given the experimental setup, 14 BPM is equivalent to 17 BPM which would allow the frac plug to move at about 200 feet/minute. After the flow test was performed, the assembly was inspected for damage.

Figure 4A:
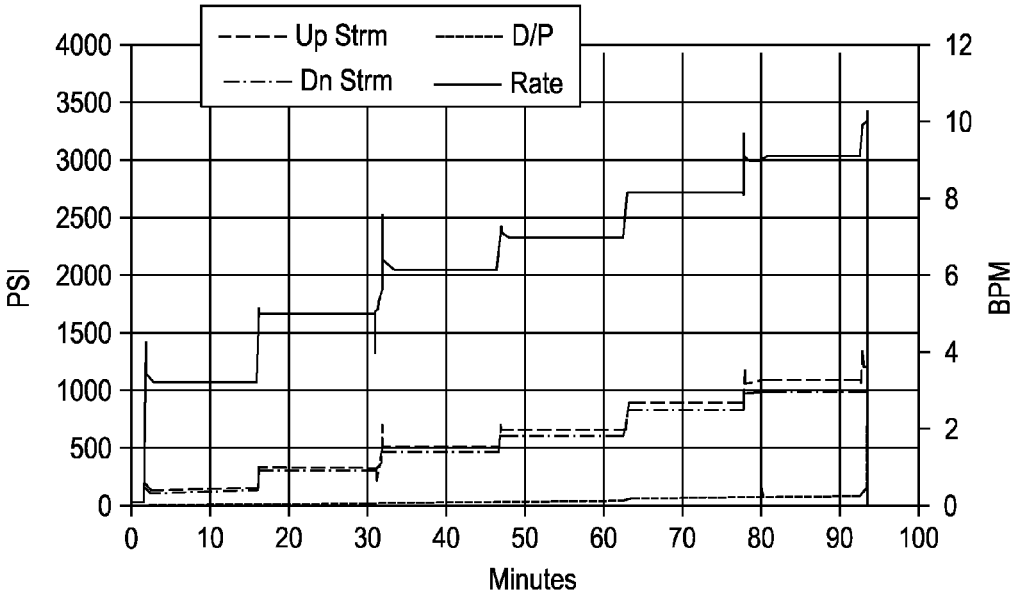
FIGS. 4A-4B are flow test results for packer apparatuses with different retaining shoe configurations.

FIG. 4A shows the flow profile and the resultant pressure upstream and downstream of the packer apparatus during the flow tests for the retaining shoe designed according to the present invention. The frac plug was able to withstand 9 barrels per minute (BPM) static flow rate before failure.

Figure 4B:
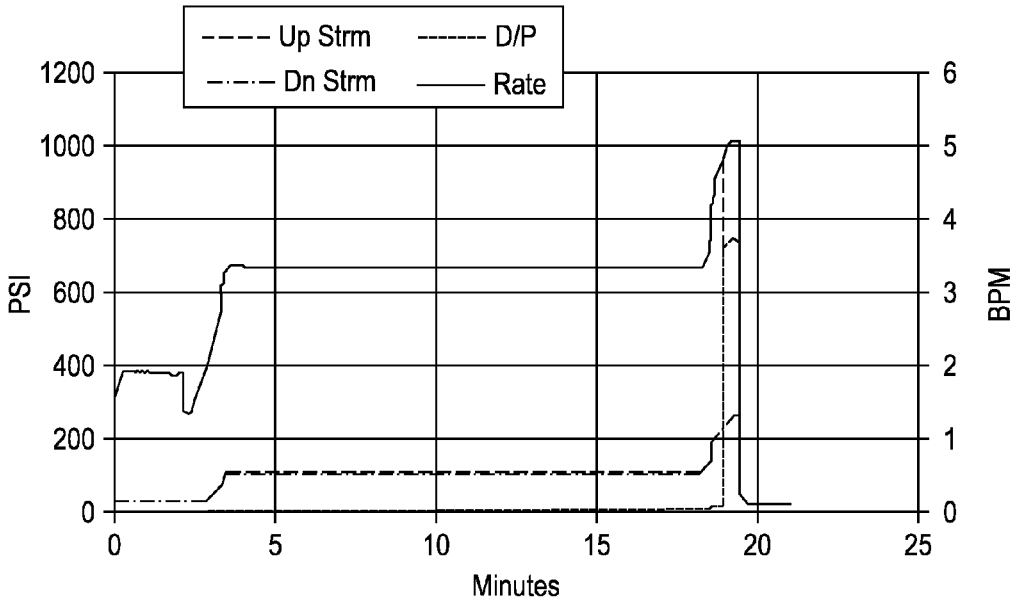

For comparison, a frac plug with a traditional retaining shoe configuration was unable to withstand greater than about 3.5 BPM static flow rate, as shown in FIG. 4B.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces, if there is any conflict in the usages of a word or term in this specification and one or more patent or other documents that may be incorporated herein by reference, the definitions that are consistent with this specification should be adopted.

The invention claimed is:

1. A downhole apparatus for use in a wellbore, the apparatus comprising:

a mandrel;

a packer element assembly disposed about the mandrel that comprises at least one packer element disposed about the mandrel; and a retaining shoe disposed about the mandrel and adjacent to a first packer element of the packer element assembly, wherein the retaining shoe comprises an inner shoe and an outer shoe such that the inner shoe is proximal to the mandrel and proximal to the first packer element relative to the outer shoe, and wherein at least a portion of an inner shoe most distal surface relative to the mandrel is covered by at least a portion of the first packer element.

2. The downhole apparatus of claim 1, wherein the inner shoe most distal surface is at least 90% covered by at least a portion of the first packer element.

3. The downhole apparatus of claim 1, wherein 100% of the inner shoe most distal surface is covered by the first packer element and at least 5% of an outer shoe surface is covered by the first packer element.

4. The downhole apparatus of claim 1, wherein the retaining shoe is nonmetallic.

5. The downhole apparatus of claim 1, wherein the wellbore is cased.

6. A downhole apparatus comprising:

a mandrel;

a packer element assembly disposed about the mandrel that comprises at least one packer element disposed about the mandrel; and a retaining shoe disposed about the mandrel and adjacent to a first packer element of the packer element assembly, wherein the retaining shoe comprises an inner shoe and an outer shoe such that the inner shoe is proximal to the mandrel and proximal to the first packer element relative to the outer shoe, and wherein in an unset position within a wellbore at least a portion of the first packer element is disposed between at least a portion of an inner shoe most distal surface relative to the mandrel and the wellbore.

7. The downhole apparatus of claim 6, wherein the retaining shoe is configured to contact the wellbore in a set position.

8. The downhole apparatus of claim 6, wherein the first packer element is configured to contact the wellbore in a set position.

9. The downhole apparatus of claim 6 further comprising:

a second retaining shoe disposed about the mandrel, wherein the packer element assembly has an upper end and a lower end with the retaining shoe and the second retaining shoe disposed at opposing ends of the packer element assembly, and wherein the second retaining shoe is adjacent to a second packer element of the packer element assembly.

10. The downhole apparatus of claim 9, wherein the packer element assembly is configured to radially expand and engage the wellbore when compressed by opposing retaining shoes.

11. The downhole apparatus of claim 9, wherein the second retaining shoe comprises a second inner shoe and a second outer shoe such that the second inner shoe is proximal to the mandrel and proximal to the second packer element relative to the second outer shoe, and wherein in the unset position within the wellbore at least a portion of the second packer element is disposed between at least a portion of a second inner shoe most distal surface relative to the mandrel and the wellbore.

12. The downhole apparatus of claim 6, wherein the wellbore is cased.

13. A downhole apparatus comprising:

a mandrel;

a packer element assembly disposed about the mandrel that comprises at least one packer element disposed about the mandrel; and a retaining shoe disposed about the mandrel and adjacent to a first packer element of the packer element assembly, wherein the retaining shoe comprises an inner shoe and an outer shoe such that the inner shoe is proximal to the mandrel and proximal to the first packer element relative to the outer shoe, and wherein an inner shoe most distal surface relative to the mandrel is proximal to the mandrel relative to an outer shoe most distal surface relative to the mandrel.

14. The downhole apparatus of claim 13, wherein the inner shoe comprises inner shoe segments and the outer shoe comprises outer shoe segments, and wherein each inner shoe segment has a corresponding outer shoe segment.

15. The downhole apparatus of claim 14, wherein the inner shoe segment and corresponding outer shoe segments are affixed.

16. The downhole apparatus of claim 14, wherein the inner shoe and the outer shoe each have at least four segments.

17. The downhole apparatus of claim 13, wherein at least a portion of the first packer element contacts at least a portion of the inner shoe most distal surface.

18. The downhole apparatus of claim 13 further comprising:

an inner wedge disposed about the mandrel, between at least a portion of the inner shoe and the mandrel, and adjacent to the first packer element; and a slip wedge disposed about the mandrel such that the retaining shoe is disposed between the first packer element and the slip wedge.

19. A method of sealing a wellbore, the method comprising:

providing a downhole apparatus comprising:

a mandrel, a packer element assembly disposed about the mandrel with an upper end and a lower end, wherein the packer element assembly comprises a first packer element at the upper end and a second packer element at the lower end, and an upper retaining shoe and a lower retaining shoe disposed about the mandrel and adjacent to the packer element assembly such that the upper retaining shoe is adjacent to the first packer element and the lower retaining shoe is adjacent to the second packer element, wherein the upper retaining shoe comprises an inner shoe and an outer shoe such that the inner shoe is proximal to the mandrel and proximal to the first packer element relative to the outer shoe, and wherein at least a portion of an inner shoe most distal surface relative to the mandrel is covered by at least a portion of the first packer element;

placing the downhole apparatus in a wellbore; and setting the downhole apparatus such that the first packer element and the second packer element expand radially and engage the wellbore when compressed by opposing retaining shoes.

* * * * *